US005117517A

United States Patent [19]

Su

[11] Patent Number: 5,117,517

[45] Date of Patent: Jun. 2, 1992

[54] SELF INFLATING CAMPING MATTRESS

[76] Inventor: Ping-Hung Su, Gymwell Corporation, 10 Silverbit La., Rolling Hills Estates, Calif. 90274

[21] Appl. No.: 744,487

[22] Filed: Aug. 13, 1991

[51] Int. Cl.[5] ..... A47C 27/18; A47C 27/15; A47G 9/06

[52] U.S. Cl. ..... 5/450; 5/420; 5/464; 5/481; 5/900.5

[58] Field of Search ..... 5/450, 420, 481, 464, 5/470, 471; 297/DIG. 3

[56] References Cited

U.S. PATENT DOCUMENTS

| | | | |
|---|---|---|---|
| 3,210,781 | 10/1965 | Pollock | 5/464 |
| 3,268,922 | 8/1966 | Moxley | 5/420 |
| 3,864,766 | 2/1975 | Prete. Jr. | 5/450 |
| 3,872,525 | 3/1975 | Lea et al. | 5/450 |
| 3,877,092 | 4/1975 | Gaiser | 5/450 |
| 4,149,919 | 4/1979 | Lea et al. | 5/450 |
| 5,048,137 | 9/1991 | Rogers | 5/481 |

FOREIGN PATENT DOCUMENTS

| | | | |
|---|---|---|---|
| 428124 | 6/1967 | Switzerland | 5/450 |

*Primary Examiner*—ALexander Grosz
*Attorney, Agent, or Firm*—Ladas & Parry

[57] ABSTRACT

An improved camping mattress. The mattress has an exterior substantially air-tight fabric covering in all sides and a valve in the fabric covering to allow the entrance and exit of air into the interior of the mattress. The interior of the mattress is an open-cell foam having a head portion at one end, a body portion at the other end, and a transition portion in between the head portion and the body portion. The head portion has a transverse thickness greater than the body portion to provide a pillow. The transition portion has a thickness at a first edge adjacent to the head portion in the range of the thickness of the head portion and a thickness at a second edge adjacent the body portion in the range of the thickness of the body portion and an upper surface between the first edge and the second edge of a substantially uniform taper. The six exterior surfaces of the open-cell foam pad are bonded to the fabric covering. The camping mattress is self inflating and may be deflated through the valve.

31 Claims, 2 Drawing Sheets

FIG. 4
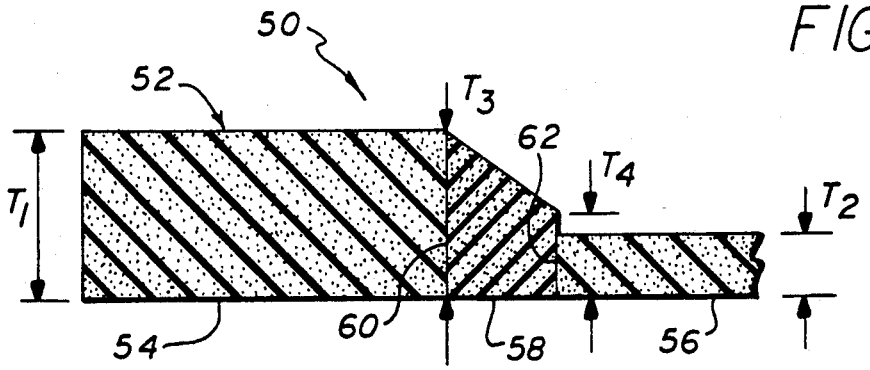
FIG. 5
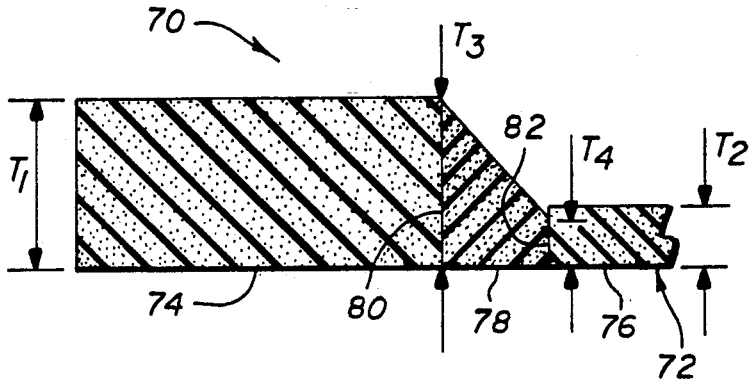
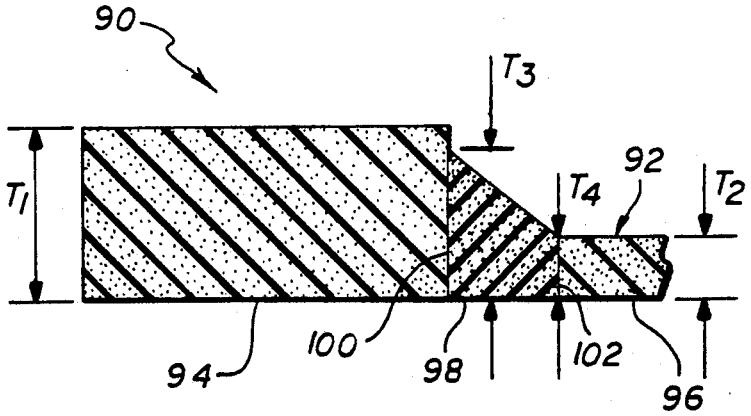
FIG. 6
FIG. 7
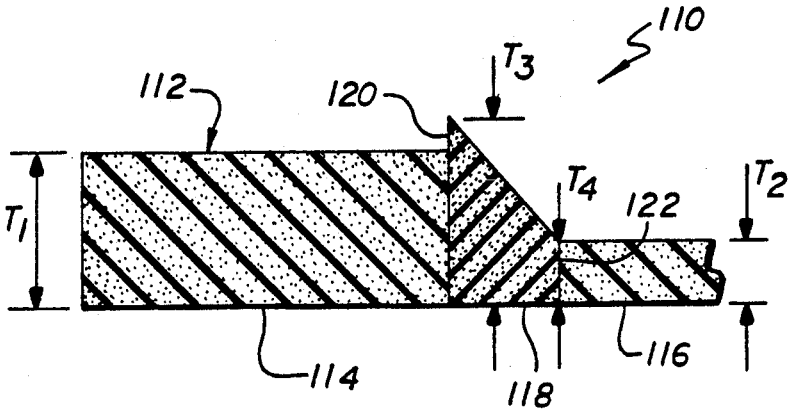

SELF INFLATING CAMPING MATTRESS

BACKGROUND OF THE INVENTION

1. Field of the Invention

This invention relates to the mattress art and, more particularly, to an improved camping mattress having a built-in pillow.

2. Description of the Prior Art

In many applications, such as outdoor camping and the like, it is desired to have a sleeping mattress to place upon the ground to be between the user and the ground surface. Such mattresses provide both an insulation from, for example, the colder temperature of ground as well as comfort. Such mattresses in the past have often been comprised of a flexible, non-stretchable, air-tight outer fabric covering and an inner, resilient plastic foam. In many of such prior art mattresses, the inner plastic foam was an open-cell polyurethane foam and all six exterior surfaces thereof were bonded to the flexible outer covering.

The flexible outer covering generally comprised a nylon outermost layer with one or more plastic layers interior of the nylon layer. The innermost plastic layer was a thermoplastic layer and the bonding of the polyurethane foam to the thermoplastic layer was done by the application of heat and pressure from a moveable platen compressing the foam and forcing the fabric layer into intimate contact with the surfaces of the foam. Such mattresses were generally termed "fully bonded, thermally bonded mattresses" and a valve was provided in the fabric covering to allow the entrance and exit of air from the open cell foam as the mat was rolled or unrolled so that the mat was self inflating. The valve could be closed to prevent the entrance of air to or exit of air from the foam as desired.

Many of the prior art camping mattresses generally did not have a pillow portion having a transverse thickness greater than the thickness of the rest of the mattress to provide the comfort of a pillow to the user. While some prior art mattresses have attempted to provide such a thicker portion generally termed a "head portion" or a "pillow portion," such prior art mattresses have not been completely satisfactory in that delamination of the fabric covering from the foam in regions adjacent the head portion often occurred in use, wrinkles or other unsightly blemishes occurred in the region of the change from the thickness of the head portion to the thickness of the body portion of the foam and, where two separate foam portions were utilized, one for the head portion and one for the body portion, a gap often occurred in the finished product because of the change in length of the portions when compressed by the platen.

It is desired, of course, that the pillow provide a "softer" feel to the user than the body portion just as, in conventional beds, a pillow provides a softer portion for the head of the user than the mattress and/or mattress-/boxspring combination.

Further, it will be appreciated, that for camping applications it is desired to have as low a weight as possible for the mattress since very often backpackers, hikers, or the like must carry all of their equipment with them in their activities.

Therefore, there has long been the need for a camping mattress that is comparatively lightweight, self inflating, and provided with a comfortable pillow portion and comfortable body portion.

SUMMARY OF THE INVENTION

Accordingly, it is an object the present invention to provide an improved mattress arrangement.

It is another object of the present invention to provide an improved camping mattress arrangement having a built-in pillow portion.

It is yet another object of the present invention to provide an improved camping mattress that is comparatively lightweight and provides a comparatively soft pillow portion for the user's head which pillow portion is thicker than the body portion of the mattress upon which the body of the user rests.

The above and other objects of the present invention are achieved, in a preferred embodiment thereof, by providing an outer fabric covering that is, preferably, flexible, non-stretchable, and air tight. In the preferred embodiments of the present invention, the fabric covering is a multi-layer fabric in which the outermost layer is nylon or any other suitable fabric such as canvas, cotton, or the like. The inside surface of the outer layer is coated with one or more layers of a plastic coating such as a thermoplastic coating. Alternatively, the inside surface of the outermost layer of the fabric covering may be provided with a multilayer construction comprised of one or more layers of a thermoplastic, one or more layers of a thermoset, and such may be applied as either a liquid coating in one or more coating layers and/or combined with one or more film layers. The inner most layer is a thermoplastic layer and the plastic layers provide a substantially air-impervious barrier for the fabric covering.

A valve is provided in the fabric covering communicating the interior of the fabric covering with regions exterior the fabric covering to allow the entrance and exit of air into and out of the interior.

Inside of the fabric covering is a foam pad and the extended upper and lower surfaces of the foam pad are bonded to the fabric covering. In the embodiments of the present invention having the innermost layer of the fabric covering as a thermoplastic, the pad is preferably a open-cell polyurethane foam and the fabric covering may be thermally bonded to the foam pad by the application of temperature and pressure which is usually applied by the use of a heated platen forcing the fabric layer onto the surface of the foam pad.

The foam pad, in the preferred embodiments of the present invention, has a head portion, a body portion, and a transition portion intermediate the head portion and body portion. The overall length of the mattress may be on the order of, for example, six feet, though greater or lesser overall length may be utilized as desired. The length of the body portion may be on the order of five feet and the length of the head portion may be on the order of one foot, though greater or lesser lengths for these two portions may be utilized. The transition portion generally has a length in the order of $\frac{1}{8}$ to $\frac{1}{2}$ inch. The thickness of the head portion may be on the order of $2\frac{3}{4}$ inches to 4 inches and the thickness of the body portion may be on the order of $1\frac{1}{4}$ to $2\frac{1}{2}$ inches. The overall width of the mattress is substantially constant throughout the length and, generally, may be on the order of 24 to 30 inches, though greater or lesser dimensions may be utilized as desired.

The transition portion has a first edge that is adjacent to the head portion and a second edge that is adjacent to the body portion. The first edge and/or the second edge may, if desired, be partially or completely bonded to the adjacent edge of the head portion and body portion, respectively, or may be free of coupling thereto. The transition portion has a thickness at the first edge that is about the same as the thickness of the head portion, slightly greater than the thickness of the head portion or slightly less than the thickness of the head portion. The thickness of the transition portion at the second edge may be about the same as the thickness of the body portion, sightly greater than the thickness of the body portion, or slightly less than the thickness of the body portion. The upper surface of the transition portion extends in generally a planar configuration from the first edge to the second edge at a substantially constant taper. The bottom surfaces of the head portion transition portion and body portion are preferably substantially coplanar.

It has been found that the use of the transition portion can avoid the delamination and wrinkling often occurring in prior art mattresses which attempted to provide a pillow portion in a camping mattress.

Preferably, the body portion has a higher density than the head portion or transition portion and the transition portion has a indentation load deflection greater than the head portion and preferably in the range of the indentation load deflection of the body portion. The compression set of the transition portion is preferably less than the compression set of the head portion and the compression set of the head portion is preferably less than the compression set of the body portion.

In other embodiments of the present invention, the flexible, non-stretchable, air-tight fabric covering may be bonded by the use of a suitable adhesive, or otherwise, to the upper and lower surfaces of the foam pad.

BRIEF DESCRIPTION OF THE DRAWINGS

The above and other embodiments of the present invention may be more fully understood from the following detailed description taken together with the accompanying drawings wherein similar reference characters refer to similar elements throughout and in which:

FIG. 4 is a sectional view illustrating another embodiment of the present invention;

FIG. 5 is a sectional view illustrating another embodiment of the present invention;

FIG. 6 is a sectional view illustrating another embodiment of the present invention; and FIG. 7 is a sectional view illustrating another embodiment of the present invention.

DESCRIPTION OF THE PREFERRED EMBODIMENTS

Figure 2:
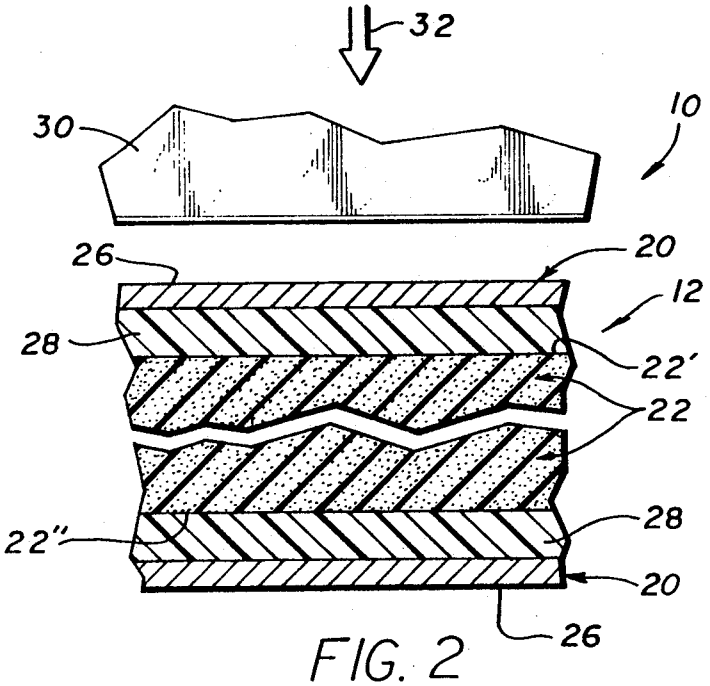
FIG. 2 is a sectional view illustrating assembling of the fabric covering to the foam pad of the present invention.
Figure 1:
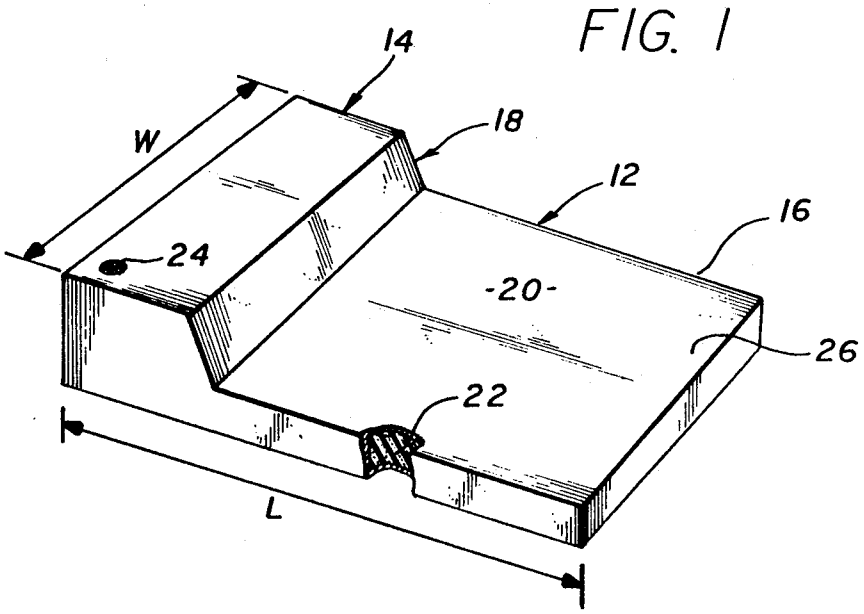
FIG. 1 is a perspective view of one embodiment of the present invention.
Figure 3:
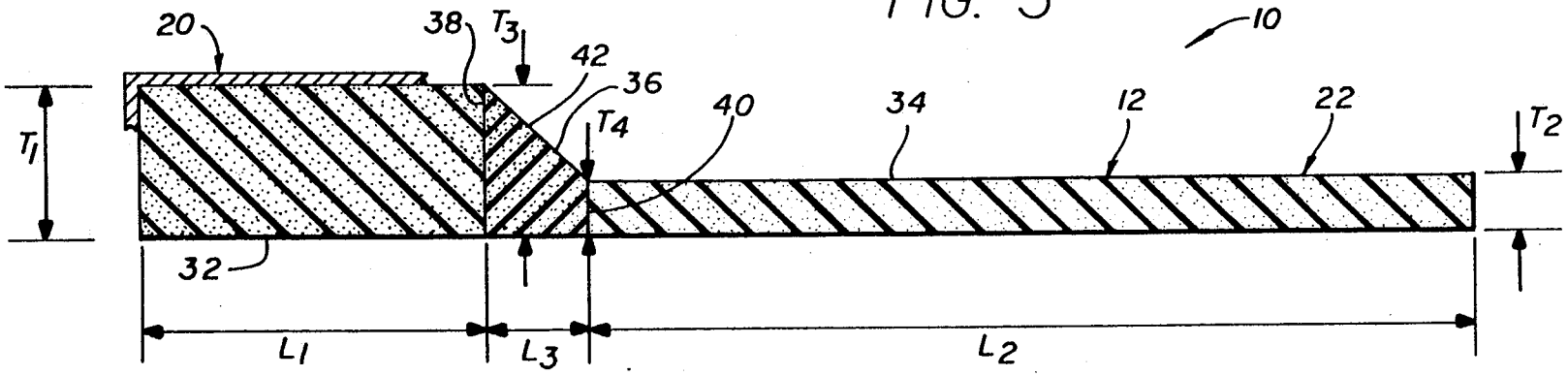
FIG. 3 is a sectional view of the embodiment shown in FIG. 1.

Referring now to the drawing, there is illustrated in FIGS. 1, 2, and 3 an embodiment generally designated 10 of the present invention in which there is a camping mattress generally designated 12 made in accordance with the principles of the present invention. The camping mattress 12 has a head portion 14, a body portion 16, and a transition portion generally indicated at 18. The camping mattress 12 is generally comprised of an outer fabric covering 20 which, in accordance with the principles of a preferred embodiment of the present invention, is preferably a flexible, non-stretchable fabric having a nylon outermost layer 26 and an interior layer of one or more plastic materials, such as thermoplastic or thermoset materials, with the innermost layer being a thermoplastic material. Inside of the fabric covering 20 there is provided a foam pad generally designated 22, preferably an open-cell foam of polyurethane. In preferred embodiments of the present invention the fabric covering 20 is bonded to the upper surface 22' and bottom surface 22" of the foam pad 22.

A valve generally designated 24 is provided in the fabric covering 20 to allow air to flow into and out of the interior of the volume occupied by the foam pad 22. Such valve may have an open position in which air may enter and leave the volume occupied by the foam pad 22 and a closed position where air is prevented from entering or leaving the interior volume occupied by the foam pad 22.

In FIG. 2 there is illustrated the camping mattress 12 in which the fabric layer 20 is being bonded to the upper surface 22" of foam pad 22. In the mattress 12 the fabric layer 20 has the outermost layer of nylon generally designated 26 and an inner layer 28 of a thermoplastic material. A platen 30 is generally heated and moved in the direction of the arrow 32 under pressure to force the thermoplastic layer 28 into contact with the upper surface 22" of foam pad 22. In this embodiment 10, the foam pad 22 becomes thermally bonded to the thermoplastic layer 28. The thermoplastic layer 28 also provides the air tight characteristic desired for the fabric covering 20. The fabric covering 20 may, in addition to a thermoplastic layer 28, have one or more layers or films of a thermoset material and one or more layers or films of a thermoplastic material as may be desired for particular applications. Alternatively, the fabric layer 20 may be bonded by adhesive or any other desired method of bonding to the foam pad 22.

FIG. 3 is a sectional view of the embodiment 10 according to the principles of the present invention showing the details of the foam pad 22. The foam pad 22 has a head portion generally designated 32, a body portion generally designated 34, and a transition portion generally designated 36. The head portion 32 has a thickness indicated on FIG. 3 at $T_1$ which, preferably, is in the range of 2.75 inches to 4.0 inches. The body portion 34 has a thickness indicated at $T_2$ in the preferred range of 1.25 to 2.5 inches.

The transition portion 36 has a first edge 38 and a second edge 40. The first edge 38 is adjacent the head portion 32 and the second edge 40 is adjacent the body portion 34. The thickness of the transition portion 36 at the first edge 38 is indicated on FIG. 3 at $T_3$ and, in the embodiment 10, is substantially the same as $T_1$ of the head portion 32. The thickness $T_4$ of the transition portion 36, at the second edge 40, is substantially the same as the thickness $T_2$ of the body portion 34.

The head portion 32 has a length indicated at $L_1$ on FIG. 3 which, preferably, may be in the range of 10 to 15 inches and the body portion 34 has a length indicated on FIG. 3 at $L_2$ in the range of 60 to 65 inches.

Greater or lesser values of all dimensions and characteristics specified herein for the various components may be utilized as desired for particular applications.

The transition portion 36 has a length indicated on FIG. 3 at $L_3$ which, preferably, is in the range of 0.125 to 0.5 inches. The transition portion 36 also has an upper surface 42 which, according to the principles of the present invention, is preferably planar and uniformly tapered from the first edge 38 to the second edge 40. The first edge 38 of the transition portion 36 may, if desired, be fully or partially bonded to the head portion 32 and a second edge 40 of the transition portion 36 may, if desired, be fully or partially bonded to the body portion 34.

The head portion 32 preferably has a density not greater than 1.2 pounds per cubic foot, a 25 percent indication load deflection of not greater than 15 pounds and a compression set of not greater than 12 percent. The body portion preferably has a density of 1.2 to 1.5 pounds per cubic foot, a 25 percent indentation load deflection between 15 and 25 pounds, and a compression set preferably not greater than 20 percent.

The transition portion has a density preferably in the range of 0.8 to 1.5 pounds per cubic foot, at 25 percent indentation load deflection of not greater than 25 pounds, and a compression set greater than 5 percent.

The sum of the lengths $L_1$ of the head portion, $L_2$ of the body portion, and $L_3$ of the transition portion are equivalent to the total length indicated by L on FIG. 1. As shown on FIG. 1, the width indicated at W is substantially the same for the head portion 14, body portion 16, and transition portion 18.

In the embodiment 10 described above, the thickness of the transition portion at the first edge adjacent to the head portion was substantially same as the thickness of the head portion and the thickness of the transition portion at the second edge adjacent to the body portion was substantially the same as the thickness of the body portion. It has been found, however, that variations in such thickness of the transition portion with respect to the thickness of the head portion and body portion may also be utilized in accordance with the principles of the present invention.

FIG. 4 illustrates an embodiment generally designated 50 of the present invention in which a foam pad generally designated 52 is provided and the foam pad 52 is generally similar to the foam pad 22 described above in that there is provided a head portion generally designated 54, a body portion generally 56, and a transition portion generally designated 58. The thickness $T_3$ of the transition portion 58 at the first edge 60 thereof is substantially the same as the thickness $T_1$ of the head portion 54. However, the thickness $T_4$ of the transition portion 58 at the second edge 62 thereof, adjacent to the body portion 56, is slightly greater than the thickness $T_2$ of the body portion 56.

FIG. 5 illustrates an embodiment generally designated 70 of the present invention in which a foam pad generally designated 72, which is substantially similar to the foam pad 22 described above, is provided and has a head portion generally designated 74, a body portion generally designated 76, and a transition portion generally designated 78. The thickness $T_3$ of the transition portion 78 at the first edge 80 thereof, adjacent to the head portion 74, is substantially the same as the thickness $T_1$ of the head portion 74. The thickness $T_4$ of the transition portion 78 at the second edge 82 thereof, adjacent to the body portion 76, is slightly less than the thickness $T_2$ of the body portion 76.

FIG. 6 illustrates another embodiment of the present invention generally designated 90 in which a foam pad 92, generally similar to the foam pad 22 described above, is provided and which has a head portion 94, a body portion 96, and a transition portion 98. In the embodiment 90, the thickness $T_3$ of the transition portion 98, at the first edge 100 thereof, is slightly less than the thickness T1 of the body portion 94. The thickness $T_4$ of the transition portion 98, at the second edge 102 thereof, is substantially the same as the thickness $T_2$ of the body portion 96.

FIG. 7 illustrates another embodiment of the present invention generally designated 110 in which there is provided a foam pad generally designated 112 substantially similar to the foam pad 22 described above and which is provided with a head portion 114, a body portion 116, and a transition portion 118. The thickness $T_3$ of the transition portion 118, at the first edge 120 thereof, is slightly greater than the thickness $T_1$ of the head portion 114, and the thickness $T_4$ of the transition portion 118, at the second edge 122, is substantially the same as the thickness $T_2$ of the body portion 116.

In other embodiments of the present invention, it will be appreciated, the various thickness illustrated in FIGS. 4, 5, 6, and 7 may be combined as desired. Therefore, in accordance with the principles of the present invention, and with the thicknesses for the head portion and body portion, as set forth above in connection with the description of FIG. 3, the thickness of the transition portion may vary from slightly less than 1.25 inches to slightly greater than 4.0 inches. The difference between the thickness of the transition portion at the first edge thereof, which is adjacent to the head portion, is preferably in the range of $\pm 0.25$ inches of the thickness of the head portion. Similarly, the thickness of the transition portion at the second edge, which is adjacent to the body portion, is preferably in the range of $\pm 0.25$ inches of the thickness of the body portion.

It will be appreciated that the width W of the mattress according to the principles of the present invention may be made in any desired width so that the mattresses may accommodate 1, 2, or more people as may be desire for particular applications. Similarly, the particular configuration of the valve 24 may be any desired configuration to allow the entrance and exit of air from the open-cell foam pad 22. It is preferred that the foam pads utilized in the present invention be open-cell foam so that the mattress 12 may be rolled up and air expelled through the valve 24 and the mattress thus retained in a relatively small configuration. When unrolled, the valve 24 may be opened to allow air to enter into the interior volume occupied by the foam pad 22 and, thus, inflate the foam pad 22 to inflate the mattress 12. When inflated (or deflated) the valve 24 may be closed to retain the inflated/deflated condition thereof.

Further, many variations of the fabric coating 20 may be utilized in the practice of the principles of the present invention and it will be appreciated that all such fabric coverings and all such methods of bonding the fabric covering to the foam pad may be utilized in the practice of the present invention.

From the above it can be seen that there has been provided an improved camping pad that is lightweight, preferably self inflating, and which has a softer pillow portion for support of the head of the user than the body portion supporting the body of the user. Such pad is substantially free of wrinkling or the tendency to delaminate by the use of the transition piece intermediate the head portion and body portion. Accordingly, the following claims are intended to cover all variations and adaptations of the present invention falling within the true scope and spirit thereof.

What is claimed:

1. In a self inflating camping mattress of the type having an outer air-tight, flexible fabric covering with a valve therein, the flexible fabric covering bonded to an open cell foam pad and the foam pad has a head portion, a body portion, and a transition portion intermediate the head portion and the body portion, the improvement comprising, in combination:

the head portion has a first predetermined length, a first predetermined width, and a first predetermined thickness;

the body portion has a second predetermined length greater than said first predetermined length, a second predetermined width substantially the same as said first predetermined width, and a second predetermined thickness less than said first predetermined thickness;

the transition portion has a first transverse edge in regions adjacent the head portion, and a second transverse edge in regions adjacent the body portion, an upper surface between said first transverse edge and said second transverse edge, the transition portion having a third predetermined length substantially less than said second and said first predetermined lengths, a third predetermined width substantially the same as said second predetermined width, and a third predetermined thickness at said first transverse edge, and a fourth predetermined thickness at said second transverse edge, and said fourth predetermined thickness is less than said third predetermined thickness and less than said first predetermined thickness, and said third predetermined thickness is greater than said second predetermined thickness; whereby the transition portion is adapted to substantially reduce the delamination and wrinkling of the flexible fabric covering bonded to the foam pad.

2. The arrangement defined in claim 1 wherein:

said upper surface of the transition portion tapers uniformly from said first edge to said second edge.

3. The arrangement defined in claim 1 wherein:

the head portion has a density substantially in the range of up to 1.2 pounds per cubic foot;

the body portion has a density substantially in the range of 1.2 to 1.5 pounds per cubic foot: and the transition portion has a density not greater than said density of the body portion.

4. The arrangement defined in claim 3 wherein:

the head portion has a 25 percent indentation load deflection of not greater than 15 pounds;

the body portion has a 25 percent indentation load deflection substantially in the range of 15 to 25 pounds; and the transition portion has a 25 percent indentation load deflection of not greater than 25 pounds.

5. The arrangement defined in claim 4 wherein:

the body portion has a compression set greater than 20 percent;

the head portion has a compression set not greater than 12 percent; and the transition portion has a compression set greater than 5 percent.

6. The arrangement defined in claim 5 wherein:

the body portion has a thickness substantially in the range of 1.25 to 2.5 inches;

the head portion has a thickness in the range of 2.75 to 4.0 inches.

7. The arrangement defined in claim 6 wherein:

the body portion has a length substantially in the range of 60 to 65 inches;

the head portion has a length in the range of 10 and 15 inches; and the transition portion has a length in the range of 0.125 to 0.500 inches.

8. The arrangement defined in claim 1 wherein:

at least one of said first edge and said second edge of the transition portion is at least partially bonded to the adjacent head portion and body portion, respectively.

9. The arrangement defined in claim 8 wherein:

said upper surface of the transition portion tapers uniformly from said first edge to said second edge.

10. The arrangement defined in claim 8 wherein:

the head portion has a density substantially in the range of up to 1.2 pounds per cubic foot;

the body portion has a density substantially in the range of 1.2 to 1.5 pounds per cubic foot; and the transition portion has a density not greater than said density of the body portion.

11. The arrangement defined in claim 10 wherein:

the head portion has a 25 percent indentation load deflection of not greater than 15 pounds;

the body portion has a 25 percent indentation load deflection substantially in the range of 15 to 25 pounds;

the transition portion has a 25 percent indentation load deflection of not greater than 25 pounds;

the body portion has a compression set greater than 20 percent;

the head portion has a compression set not greater than 12 percent; and the transition portion has a compression set greater than 5 percent.

12. The arrangement defined in claim 11 wherein:

the body portion has a thickness substantially in the range of 1.25 to 2.5 inches;

the head portion has a thickness in the range of 2.75 to 4.0 inches;

the body portion has a length substantially in the range of 60 to 65 inches;

the head portion has a length in the range of 10 to 15 inches; and the transition portion has a length in the range of 0.125 to 0.500 inches.

13. The arrangement defined in claim 12 wherein:

at least one of said first edge and said second edge of the transition portion is at least partially bonded to the adjacent head portion and body portion, respectively.

14. The arrangement defined in claim 12 wherein:

said first edge of said transition portion is at least partially bonded to the head portion; and said second edge of the transition portion is at least partially bonded to the body portion.

15. The arrangement defined in claim 14 wherein:

said upper surface of the transition portion tapers uniformly from said first edge to said second edge.

16. The arrangement defined in claim 13 wherein:

said upper surface of the transition portion tapers uniformly from said first edge to said second edge.

17. The arrangement defined in claim 13 wherein:

said upper surface of the transition portion tapers uniformly from said first edge to said second edge.

18. The arrangement defined in claim 1 wherein:

said first edge of said transition portion is at least partially bonded to the head portion; and said second edge of the transition portion is at least partially bonded to the body portion.

19. The arrangement defined in claim 18 wherein:

said upper surface of the transition portion tapers uniformly from said first edge to said second edge.

20. The arrangement defined in claim 18 wherein:

the head portion has a density substantially in the range of up to 1.2 pounds per cubic foot;

the body portion has a density substantially in the range of 1.2 to 1.5 pounds per cubic foot; and the transition portion has a density not greater than said density of the body portion.

21. The arrangement defined in claim 20 wherein:

the head portion has a 25 percent indentation load deflection of not greater than 15 pounds;

the body portion has a 25 percent indentation load deflection substantially in the range of 15 to 25 pounds;

the transition portion has a 25 percent indentation load deflection of not greater than 25 pounds;

the body portion has a compression set greater than 20 percent;

the head portion has a compression set not greater than 12 percent; and the transition portion has a compression set greater than 5 percent.

22. The arrangement defined in claim 21 wherein:

the body portion has a thickness substantially in the range of 1.25 to 2.5 inches;

the head portion has a thickness in the range of 2.75 to 4.0 inches;

the body portion has a length substantially in the range of 60 to 65 inches;

the head portion has a length in the range of 10 to 15 inches; and the transition portion has a length in the range of 0.125 to 0.500 inches.

23. The arrangement defined in claim 22 wherein:

at least one of said first edge and said second edge of the transition portion is at least partially bonded to the adjacent head portion and body portion, respectively.

24. The arrangement defined in claim 22 wherein:

said first edge of said transition portion is at least partially bonded to the head portion; and said second edge of the transition portion is at least partially bonded to the body portion.

25. The arrangement defined in claim 22 wherein:

said upper surface of the transition portion tapers uniformly from said first edge to said second edge.

26. The arrangement defined in claim 1 wherein:

said third determined thickness is substantially the same as the first predetermined thickness; and said fourth predetermined thickness is substantially the same as said second predetermined thickness.

27. The arrangement defined in claim 1 wherein:

said third predetermined thickness is less than said first predetermined thickness; and said fourth predetermined thickness is greater than said second predetermined thickness.

28. The arrangement defined in claim 1 wherein:

said third predetermined thickness is greater than said first predetermined thickness.

29. The arrangement defined in claim 1 wherein:

said fourth predetermined thickness is less than said second predetermined thickness.

30. The arrangement defined in claim 1 wherein:

said third predetermined thickness is substantially the same as said first predetermined thickness.

31. The arrangement defined in claim 1 wherein:

said fourth predetermined thickness is substantially the same as said second predetermined thickness.

* * * * *